US009736912B2

(12) United States Patent
Kusakari

(10) Patent No.: US 9,736,912 B2
(45) Date of Patent: Aug. 15, 2017

(54) ILLUMINATION DEVICE AND COMMUNICATION SYSTEM

(71) Applicant: Shin Kusakari, Kanagawa (JP)

(72) Inventor: Shin Kusakari, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 216 days.

(21) Appl. No.: 14/557,850

(22) Filed: Dec. 2, 2014

(65) Prior Publication Data

US 2015/0163887 A1 Jun. 11, 2015

(30) Foreign Application Priority Data

Dec. 9, 2013 (JP) ..... 2013-254138
Sep. 3, 2014 (JP) ..... 2014-178969

(51) Int. Cl.

| | |
|---|---|
| ***H05B 37/02*** | (2006.01) |
| ***F21K 9/27*** | (2016.01) |
| *F21S 8/00* | (2006.01) |
| *F21S 9/02* | (2006.01) |
| *F21V 23/04* | (2006.01) |
| *F21V 29/85* | (2015.01) |
| *F21Y 101/00* | (2016.01) |
| *F21Y 115/10* | (2016.01) |

(52) U.S. Cl.

CPC ..... *H05B 37/0272* (2013.01); *F21K 9/27* (2016.08); *F21S 8/031* (2013.01); *F21S 9/022* (2013.01); *F21V 23/045* (2013.01); *F21V 29/85* (2015.01); *F21Y 2101/00* (2013.01); *F21Y 2115/10* (2016.08)

(58) Field of Classification Search

CPC ..... H05B 37/0272; F21Y 2101/02; F21V 23/045; F21V 29/85; F21S 9/022; F21S 8/031; F21K 9/17; F21K 9/175

See application file for complete search history.

(56) References Cited

U.S. PATENT DOCUMENTS 8,280,398 B2 10/2012 Ishii et al.
2005/0096073 A1* 5/2005 Bahl ..... H04W 52/46 455/516

(Continued)

FOREIGN PATENT DOCUMENTS

JP H10283807 A 10/1998
JP 2005347827 A 12/2005

(Continued)

OTHER PUBLICATIONS

Japanese Office Action dated Jun. 7, 2016.

*Primary Examiner* — Douglas W Owens
*Assistant Examiner* — Jonathan G Cooper
(74) *Attorney, Agent, or Firm* — Harness, Dickey & Pierce, P.L.C.

(57) ABSTRACT

An illumination device includes a reception portion configured to receive a terminal ID stored by a radio terminal; a transmission portion configured to transmit the received terminal ID and a device ID; an illumination portion configured to emit light from a light source; and a housing portion configured to be detachably provided to the illumination portion and include a secondary battery capable of supplying power to the reception portion and the transmission portion.

20 Claims, 11 Drawing Sheets

(56) References Cited

U.S. PATENT DOCUMENTS

2008/0278324 A1* 11/2008 Uchimura ..... G01S 1/70 340/572.1
2009/0289503 A1* 11/2009 Hayashi ..... H02J 7/0068 307/66
2010/0039240 A1* 2/2010 Rodriguez ..... H05B 37/0272 340/12.3
2010/0081378 A1* 4/2010 Kawamura ..... H02J 7/025 455/41.1
2010/0141153 A1* 6/2010 Recker ..... H05B 33/0803 315/149
2010/0168878 A1* 7/2010 Hoonhout ..... A61L 9/12 700/90
2012/0013440 A1* 1/2012 von Bose ..... G06K 17/0029 340/5.85
2013/0234893 A1 9/2013 Kusakari et al.
2013/0244697 A1 9/2013 Kusakari et al.
2013/0316729 A1 11/2013 Ohashi et al.
2013/0324153 A1 12/2013 Miyawaki et al.
2013/0328893 A1 12/2013 Kusakari
2013/0329423 A1 12/2013 Kusakari
2013/0330085 A1 12/2013 Kusakari
2013/0331037 A1 12/2013 Kusakari
2013/0331038 A1 12/2013 Kusakari
2013/0342399 A1 12/2013 Fukuda et al.
2014/0004879 A1 1/2014 Matsushita et al.
2014/0071853 A1* 3/2014 Ohashi ..... H04W 4/02 370/254
2014/0079200 A1 3/2014 Kusakari
2014/0087710 A1 3/2014 Kusakari et al.
2014/0087766 A1 3/2014 Kusakari et al.
2014/0087767 A1 3/2014 Kusakari et al.
2014/0087768 A1 3/2014 Kusakari et al.

FOREIGN PATENT DOCUMENTS

JP 2006100036 A 4/2006
JP 2009017267 A 1/2009
JP 2010009824 A 1/2010
JP 2013206853 A 10/2013
JP 2013-246118 12/2013
WO WO 2005/086375 9/2005

* cited by examiner

FIG.16

| DEVICE ID | POSITION |
|---|---|
| C20N001 | (x1, y1) |
| C20N002 | (x2, y2) |
| C20N003 | (x3, y3) |
| ⋮ | ⋮ |

FIG.17

| TERMINAL ID | POSITION | DATE AND TIME |
|---|---|---|
| 000535 | (x1, y1) | 2013/11/21 13:14:00 |
| 000536 | (x2, y2) | 2013/11/20 13:14:55 |
| 000537 | (x3, y3) | 2013/11/21 13:15:30 |
| ⋮ | ⋮ | ⋮ |

ILLUMINATION DEVICE AND COMMUNICATION SYSTEM

BACKGROUND OF THE INVENTION

1. Field of the Invention

The present invention relates to an illumination device and a communication system.

2. Description of the Related Art

Various position information management systems have been proposed to acquire a position(s) of a person and/or a thing in a facility where it is difficult to carry out precise positioning using the Global Positioning System (GPS). For example, a system has been proposed to acquire a position of a person or a thing by attaching a Radio-Frequency IDentification (RFID) tag thereto from which information is readable by radio.

International Publication No. 2005/086375 (Patent Reference No. 1) discloses a system in which a radio terminal receives unique information transmitted by an illumination device and transmits the unique information to a server, whereby the position of the radio terminal is determined.

SUMMARY OF THE INVENTION

According to one aspect of the present invention, an illumination device includes a reception portion configured to receive a terminal ID stored by a radio terminal; a transmission portion configured to transmit the received terminal ID and a device ID; an illumination portion configured to emit light from a light source; and a housing portion configured to be detachably provided to the illumination portion and include a secondary battery capable of supplying power to the reception portion and the transmission portion.

Other objects, features and advantages of the present invention will become more apparent from the following detailed description when read in conjunction with the accompanying drawings.

BRIEF DESCRIPTION OF THE DRAWINGS

FIG. 16 illustrates one example of a table storing position information according to the embodiment;

FIG. 17 illustrates one example of a table storing radio terminal information according to the embodiment.

DETAILED DESCRIPTION OF THE EMBODIMENT

Figure 1:
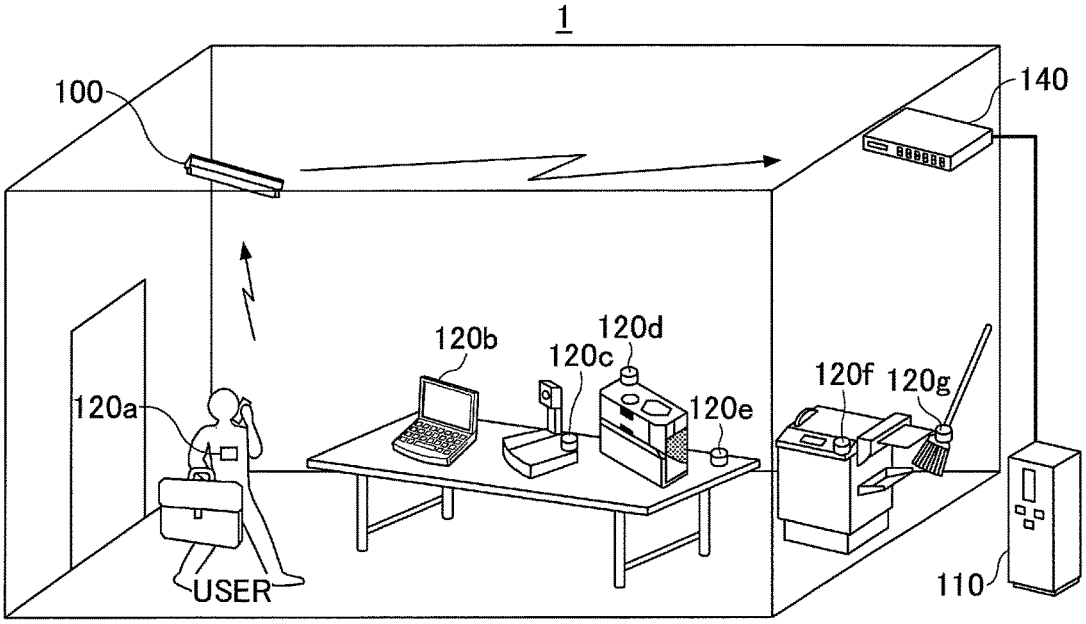
FIG. 1 illustrates a general concept of an embodiment of the present invention.

In the related art described above, an illumination device functions as a positioning system while the power is supplied to the illumination device. However, when the power supply to the illumination device is cut off, the illumination device no longer transmits the unique information and no longer has the positioning function.

The embodiment of the present invention has been devised in consideration of such a situation and an object of the embodiment is to provide an illumination device by which it is possible to still have a communication function to be used for a system managing position information even after the power supply is cut off.

According to the embodiment, it possible to provide an illumination device by which it is possible to still have a communication function to be used for a system managing position information even after the power supply is cut off.

Below, based on the figures, the embodiment of the present invention will be described. In each figure, the same reference numerals are given to the same components/parts and duplicate description may be omitted.

<1. Summary of Embodiment>

FIG. 1 illustrates a general concept of the embodiment of the present invention. More specifically, FIG. 1 illustrates a general concept of a position management system 1 including a communication system according to the embodiment.

The position management system 1 includes radio terminals 120*a*-120*g* (hereinafter, generally referred to as radio terminals 120) attached to and/or incorporated into a person and various things; a luminaire 100; a gateway 140; and a management apparatus 110. The position management system 1 monitors the positions of the person and things by acquiring terminal IDs given to the radio terminals 120 in predetermined timing via the luminaire 100 provided in a space.

The luminaire 100 transmits a device ID that is previously associated with its position and the terminal IDs acquired from the radio terminals 120 in combination to the management apparatus 110. The management apparatus 110 has information indicating correspondence between the device ID of each luminaire 100 and its associated position. Therefore, by associating the terminal ID with the position, the management apparatus 110 can determine the position of each radio terminal 120.

The radio terminal 120*a* can be incorporated in or attached to the outside of an employee ID card or an ID card that the person carries. The radio terminal 120*b*-120*g* can be incorporated into or attached to the outside of a PC, a projector, a conference terminal, a desk, a multifunction peripheral and a cleaning utensil, respectively. The radio terminals 120 can transmit respective beacon signals including the their assigned terminal IDs by using any radio communication such as extremely low power radio, specified low power radio, low power radio or so.

<Outline of Radio Terminal>

Figure 2:
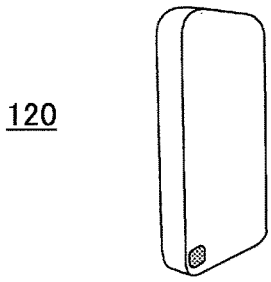
FIG. 2 illustrates an external view of a radio terminal according to the embodiment.

FIG. 2 illustrates an external view of the radio terminal 120. The radio terminal 120 illustrated in FIG. 2 is a tag-like radio terminal to be attached to a person or a thing. The radio terminal 120 illustrated in FIG. 2 is a small scale tag of 27 mm in height×45 mm in width×7 mm in depth having a weight of approximately 8 grams and can carry out communication with the luminaire 100 by extremely low power radio of the 315 MHz band.

The luminaire 100 forming a radio network together with other luminaires and the gateway 140 and transmits the terminal ID received from the radio terminal 120 to the management apparatus 110 via other luminaires and the gateway 140.

Figure 3:
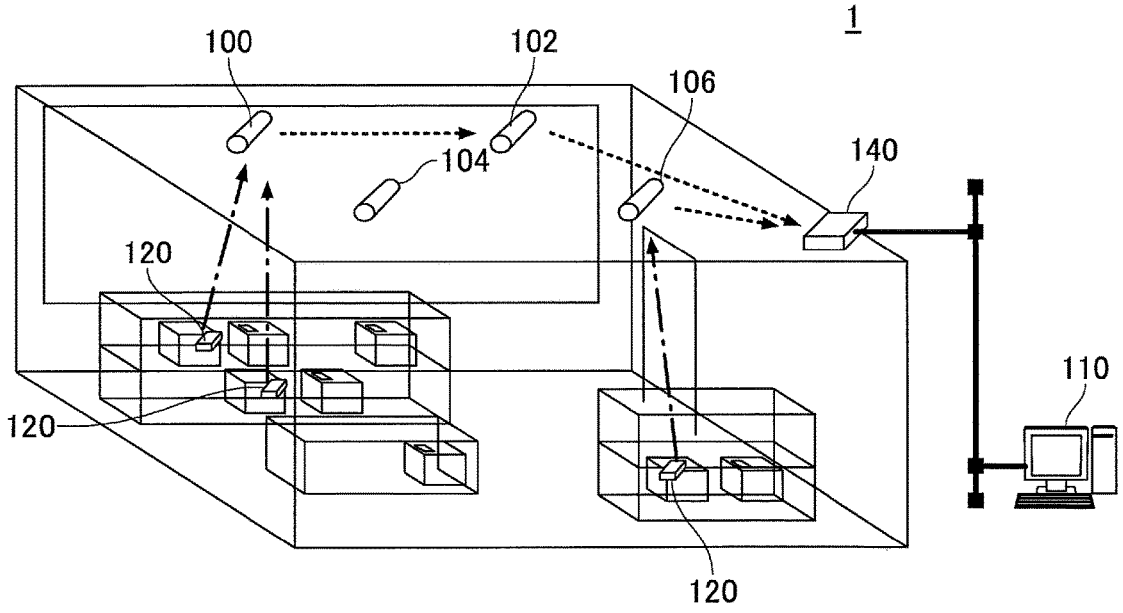
FIG. 3 illustrates a radio network according to the embodiment.

FIG. 3 illustrates an example where the luminaire 100 receives the terminal IDs from the radio terminals 120 attached to things such as containers for which position management is to be carried out. The luminaire 100 transmits the thus received terminal IDs together with its own device ID to the management apparatus 110 via the gateway 140 (and also, another luminaire 102, if necessary). The radio network can be formed by using short range radio communication such as IEEE 802.15.4 and ZigBee (registered trademark), Bluetooth (registered trademark) or a wireless LAN.

Figure 4:
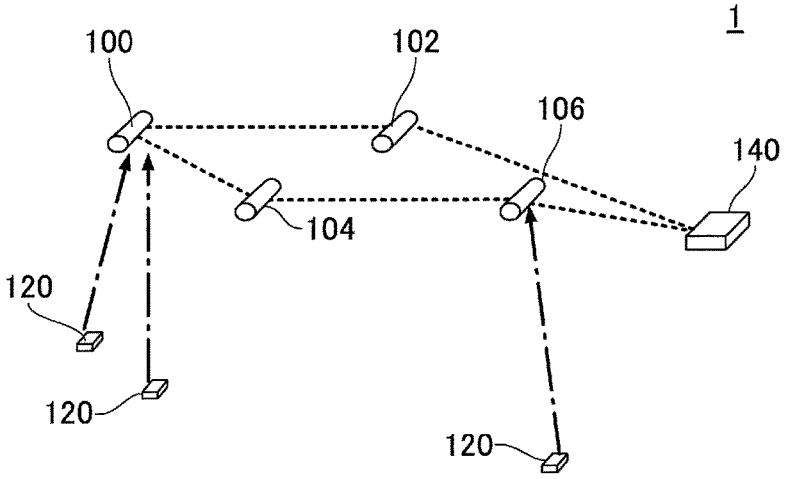
FIG. 4 illustrates the radio network according to the embodiment.

Note that FIG. 4 illustrates the radio terminals 120 illustrated in FIG. 2, as well as a plurality of luminaires 100, 102 and 104 and 106, and the gateway 140, also forming the radio network together, in a manner of extracting them.

The gateway 140 is an apparatus/device to connect the radio network which is formed thereby together with the luminaire 100 and so forth with a wired network which connects with the management apparatus 110. When ZigBee is used for forming the radio network, the gateway 140 has a function of a ZigBee coordinator configuring and managing the radio network.

The management apparatus 110 is an apparatus/device to receive IDs transmitted from the luminaire 100 via the gateway 140. The management apparatus 110 stores the device ID given to the luminaire 100 and the position where the luminaire 100 is installed in a manner of associating them with one another.

<Outline of Luminaire>

Next, the configuration of and an example of installing the luminaire 100 will be described using figures.

Figure 5:
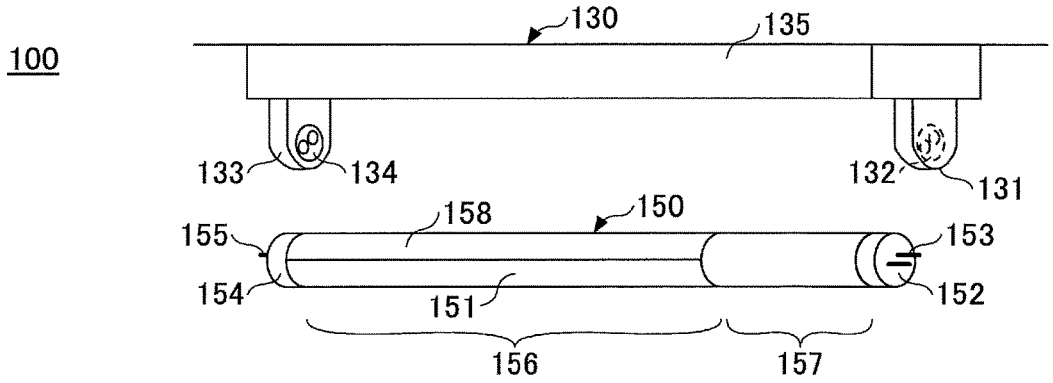
FIG. 5 illustrates an external view of the entirety of a luminaire according to the embodiment.

FIG. 5 illustrates an external view of the entirety of the luminaire 100 according to the embodiment. The luminaire 100 includes an illumination device 150 that is a straight tube lamp emitting light and a luminaire body 130 to which the illumination device 150 is mounted.

The device ID to be transmitted by the luminaire 100 according to the embodiment is stored in a storage device provided in the illumination device 150. The illumination device 150 receives a beacon signal from the radio terminal 120, thus acquires the terminal ID and transmits the device ID together with the acquired terminal ID to the management apparatus 110. Below, the configurations of the luminaire body 130 and the illumination device 150 will be described in more detail.

<Luminaire Body>

The luminaire body 130 is installed, for example, on a ceiling indoors. The luminaire body 130 includes a body 135 mounted on the ceiling, and a first socket 131 and a second socket 133 to which the respective ends of the illumination device 150 are inserted. The first socket 131 has power supply terminals 132 to supply the power to the illumination device 150. The second socket 133 has power supply terminals 134 to supply the power to the illumination device 150. The luminaire body 130 supplies the power to the illumination device 150, the respective ends of which are fitted to the first socket 131 and the second socket 133, from a power supply portion provided inside via the power supply terminals 132 and 134. Alternatively, it is also possible that the luminaire body 130 supplies the power to the illumination device 150 using only the power supply terminals 132 or the power supply terminals 134 (i.e., "one-side feeding").

<Illumination Device>

Figure 6:
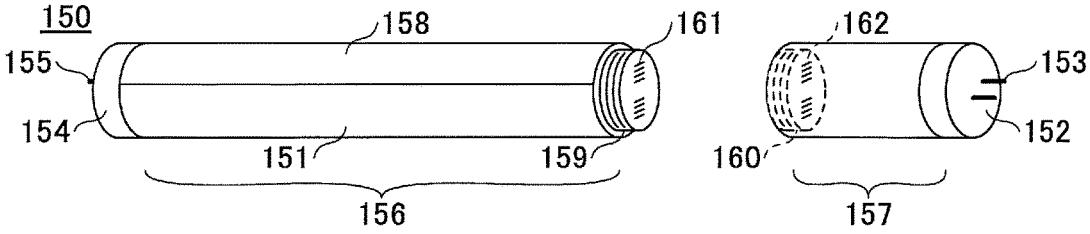
FIG. 6 illustrates an external view of an illumination device according to the embodiment.

The illumination device 150 includes an illumination portion 156, a housing portion 157, bases 152 and 154 provided at both ends, and connection terminals 153 and 155. The illumination portion 156 and the housing portion 157 are coupled with one another detachably as shown in FIG. 6. Note that the size and shape of the whole illumination device 150, the shapes of the bases 152 and 154, and so forth, can be determined according to the national standard of the country where the illumination device 150 is installed, or so, and are not limited to those described below.

The illumination portion 156 includes a structure portion 158, a translucent cover 151, an external thread structure 159 provided at the end of the side of the housing portion 157 and connection terminals 161 provided on the end face of the extending end of the external thread structure 159, and includes a light source inside. The structure portion 158 is made of a magnesium alloy or such having high heat conductivity. The translucent cover 151 is made of a resin material such as an acrylic resin and transmits light emitted by the light source.

The housing portion 157 includes an internal thread structure 160 provided at the end of the side of the illumination portion 156 and connection terminals 162 provided on the end face inside the internal thread structure 160, and includes a secondary battery inside. Note that, in the illumination device 150, it is preferable to increase the size of the illumination portion 156 as much as possible and reduce the size of the housing portion 157 for improving the brightness, while it is preferable to reduce the weight of the illumination device 150 for improving handleability.

The external thread structure 159 of the illumination portion 156 and the internal thread structure 160 of the housing portion 157 are configured in such a manner that, when they are screwed together, the connection terminals 161 of the illumination portion 156 and the connection terminals 162 of the housing portion 157 come into contact with each other, respectively.

The illumination device 150 is mounted on the luminaire body 130 as a result of, in a state where the illumination portion 156 is coupled with the housing portion 157, the bases 152 and 154 being fitted into the first socket 131 and the second socket 133, respectively.

The connection terminals 153 and 155 receive the power as a result of being connected with the power supply terminals 132 and 134 of the luminaire body 130 when the illumination device 150 is mounted on the luminaire body 130. Alternatively, it is also possible that only the connection terminals 153 or the connection terminals 155 receive the power from the power supply terminals 132 or the power supply terminals 134. The light source provided inside the illumination portion 156 emits light by using the power supplied from the connection terminals 153 and 155 and emits the light through the translucent cover 151. The secondary battery provided in the housing portion 157 stores some of the energy supplied from the connection terminals 153 and 155.

<Configuration of Illumination Device>

Figure 7:
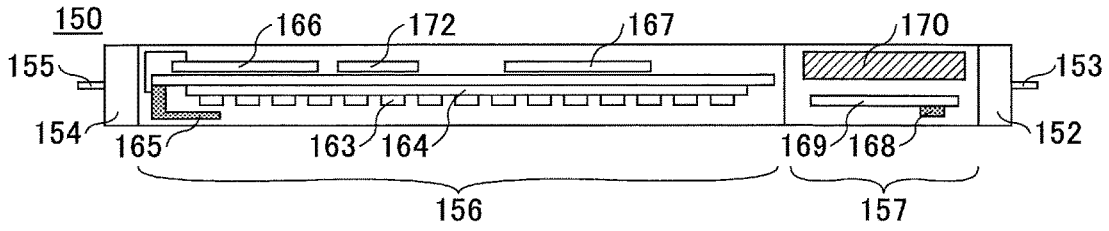
FIG. 7 illustrates a general longitudinal sectional view of the illumination device according to the embodiment in one example.

FIG. 7 illustrates a general longitudinal sectional view of the illumination device 150 according to the embodiment in one example. As shown in FIG. 7, the illumination portion 156 of the illumination device 150 includes a substrate 164 having a plurality of LED elements 163 arranged inside, a first radio communication device 165, a first radio communication module 166, a power source module 167 and a CPU module 172. The housing portion 157 includes a second radio communication device 168, a second radio communication module 169 and a secondary battery 170.

The first radio communication module 166 is, for example, a substrate including a circuit functioning as a radio communication control portion controlling communication between the first radio communication device 165 and the radio terminal 120. For example, the first radio communication module 166 is a beacon receiver of extremely low power radio.

The second radio communication module 169 is, for example, a substrate including a circuit functioning as a radio communication control portion controlling communication between the second radio communication device 168 and the management apparatus 110. For example, the second radio communication module 169 is a router or an end device of short range radio communication.

The CPU module 172 is a substrate having a function of providing instructions to the first radio communication module 166 and the second radio communication module 169 and controlling data flows.

The power source module 167 is a substrate having a circuit functioning as a power control portion rectifying and smoothing the power supplied from the connection terminals 153 and 155 and a voltage conversion portion converting the voltage thereof.

The secondary battery 170 is, for example, a lithium ion secondary battery, and stores the energy supplied from the connection terminals 153 and 155. Note that the secondary battery 170 is not limited to a lithium ion secondary battery and can be any other secondary battery as long as it is changeable. The secondary battery 170 stores the energy supplied to the illumination device 150 while the power is supplied to the luminaire 100. The secondary battery 170 functions as an auxiliary power source, and supplies the power to the first radio communication module 166 and the second radio communication module 169 to allow them to operate after the power supply to the luminaire 100 is cut off.

Thus, as a result of the illumination device 150 having the secondary battery 170, the power is still supplied to the first radio communication module 166 and the second radio communication module 169 from the secondary battery 170 even after the power supply to the luminaire 100 is cut off. As a result, even after the power supply to the luminaire 100 is cut off, the functions necessary for the position management system 1 are maintained.

Further, in the illumination device 150, the secondary battery 170 is placed in the housing portion 157 different from the illumination portion 156 having the LED elements 163 and is provided in a space segregated from the LED elements 163 generating heat. Therefore, it is possible to reduce a likelihood of a deterioration of the secondary battery 170 resulting from being affected by heat generated by the substrate 164 in which the LED elements 163 are arranged, or so.

Further, in the illumination device 150, the housing portion 157 can be replaced. When the secondary battery 170 is deteriorated due to repetitious charging and discharging operations, it is possible to further continuously use the illumination device 150 by replacing only the housing portion 157 while the illumination portion 156 including the LED elements 163 that can be still continuously used is left unreplaced.

Thus, in the illumination device 150 according to the embodiment, since the secondary battery 170 is installed in the housing portion 157 that is detachably mounted to the illumination portion 156 including the LED elements 163, it is possible to reduce a deterioration of the secondary battery 170 due to heat. Also, since it is possible to replace only the housing portion 157 when the secondary battery 170 is deteriorated, it is possible to further continuously use the illumination portion 156 including the LED elements 163 and thus, it is possible to reduce the running cost and the load to the environment.

Note that, it is also possible that the first radio communication device 165 and the first radio communication module 166 are installed in the housing portion 157 while the second radio communication device 168 and the second radio communication module 169 are installed in the illumination portion 156.

Figure 8:
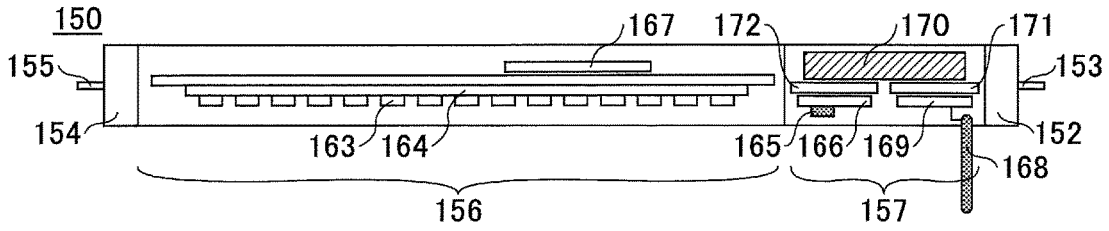
FIG. 8 illustrates a general longitudinal sectional view of the illumination device according to the embodiment in another example.

Further, as shown in FIG. 8, it is also possible to install the first radio communication device 165, the first radio communication module 166, the voltage conversion module 171 and the CPU module 172 in the housing portion 157 in addition to the second radio communication device 168, the second radio communication module 169 and the secondary battery 170. If the first radio communication device 165 and the second radio communication device 168 are installed in the illumination portion 156, they may block light emitted from the LED elements 163. However, by installing them in the housing portion 157, the light from the LED elements 163 is not blocked thereby.

Figure 9:
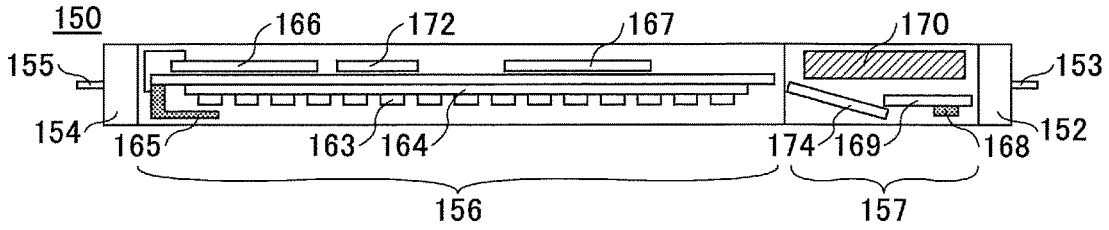
FIG. 9 illustrates a general longitudinal sectional view of the illumination device according to the embodiment in yet another example.

Further, as shown in FIG. 9, it is possible to install a light reflection member 174 reflecting light emitted by the LED elements 163 in the housing portion 157. In this case, portions of the illumination portion 156 and the housing portion 157 where they are coupled with one another are made of translucent materials. Since the light reflection member 174 reflects light emitted by the LED elements 163, the illumination device 150 can emit light in a wider range.

<Example of Installing Luminaire>

Figure 10:
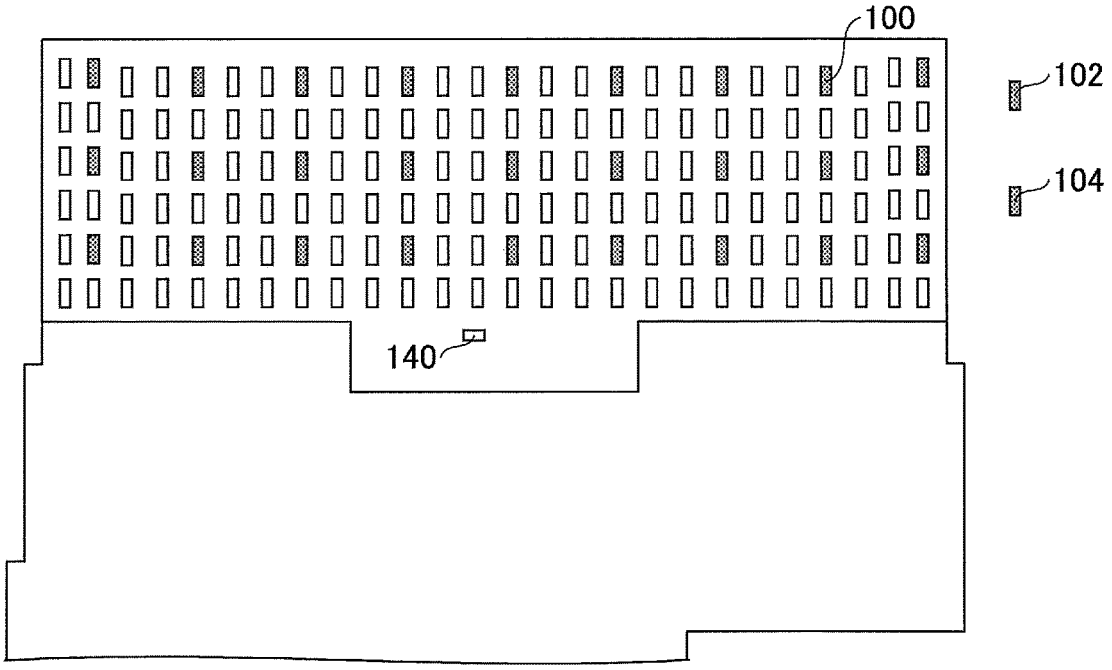
FIG. 10 illustrates one example of an installation layout of illumination devices according to the embodiment.

FIG. 10 illustrates a state where a plurality of luminaires are installed in an office, and the luminaires installed on a ceiling of the office are expressed by respective rectangles. Among all the 156 luminaires shown in FIG. 10, luminaires 100, 102 and 104 according to the embodiment are expressed as respective rectangles having dots therein, while normal luminaires are expressed as respective blank rectangles.

The luminaires 100, 102 and 104 each of which has the above-mentioned configuration, and can carry out communication with the radio terminals 120 present in the office. The other luminaires have common fluorescent lamps or LED lamps. In the example of FIG. 10, the luminaires according to the present embodiment are installed in a ratio of approximately one per six luminaires. Note that the specific numbers, positions and so forth of the luminaires 100, 102, 104 and so forth according to the present embodiment can be appropriately changed depending on an installation environment.

The illumination device 150 mounted in the luminaire body 130 of the luminaire 100 carries out communication with the gateway 140 and forms a radio network. When receiving the terminal ID from the radio terminal 120 present in the office, the illumination device 150 transmits the terminal ID and the device ID to the gateway 140.

<2. Hardware Configuration>

Next, hardware configurations of the illumination device 150 and the radio terminal 120 will be described.

<Hardware Configuration of Illumination Device>

Figure 11:
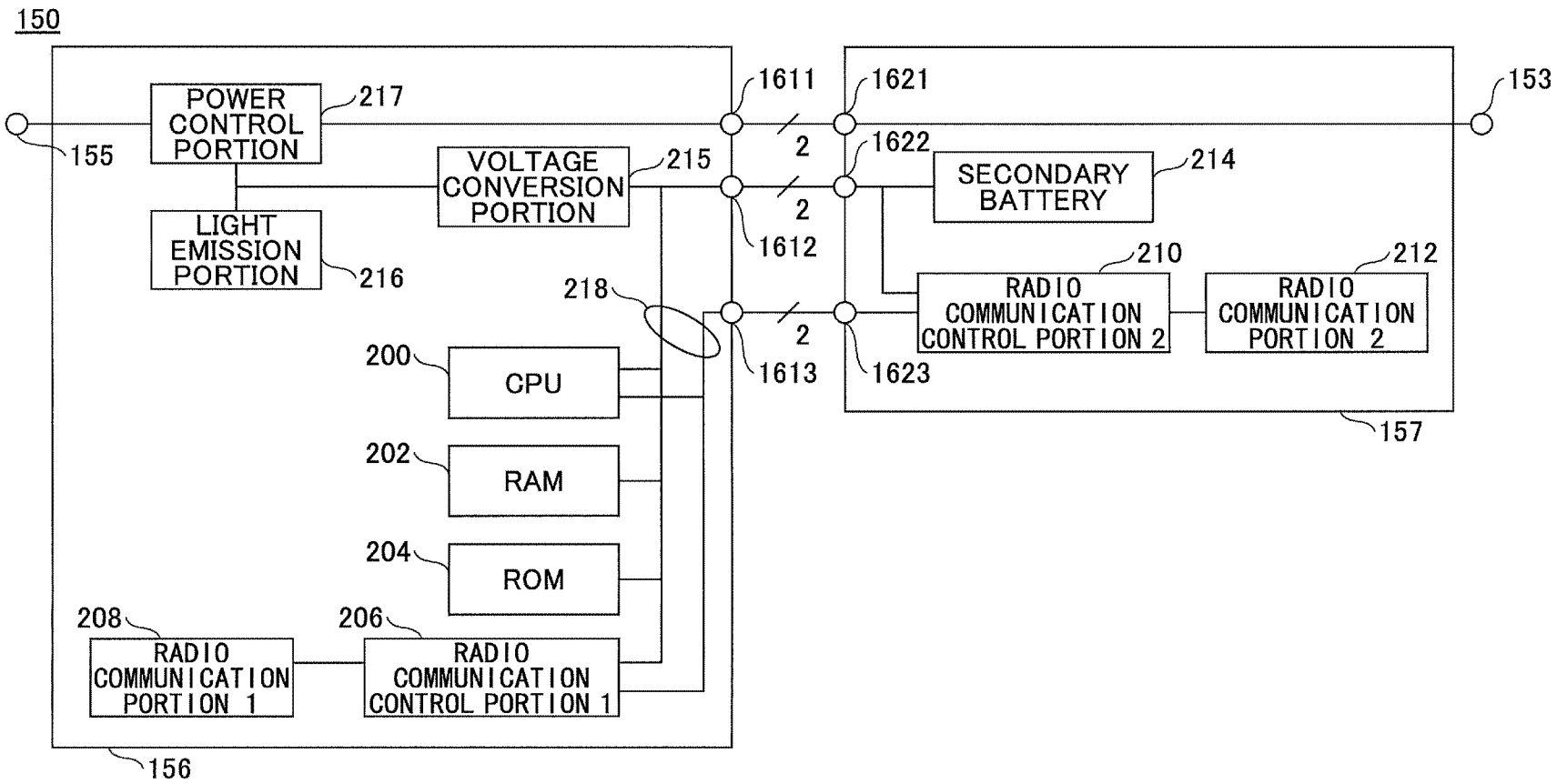
FIG. 11 illustrates hardware configurations of the illumination device according to the embodiment in one example.

FIG. 11 illustrates a hardware configuration of the illumination device 150 according to the embodiment.

The illumination portion 156 of the illumination device 150 includes a power control portion 217, a light emission portion 216, a voltage conversion portion 215, a CPU 200, a RAM 202, a ROM 204, a radio communication control portion 1, 206, a radio communication portion 1, 208 and a bus 218.

The CPU 200 executes a program(s) to carry out operation control of communication and so forth in the illumination device 150. The RAM 202 provides a work area for the CPU 200. The ROM 204 stores the program(s) executed by the CPU 200. The radio communication control portion 1, 206 receives the terminal ID transmitted by the radio terminal 120 via the radio communication portion 1, 208.

The power control portion 217 includes, for example, a rectifying and smoothing circuit and a current monitoring circuit, and converts the supplied power to one suitable for operating the light emission portion 216. The voltage conversion portion 215 converts the output voltage of the power control portion 217 into a voltage by which the CPU 200, the radio communication control portion 1, 206 and so forth can operate. The bus 218 electrically connects the above-mentioned respective portions.

The housing portion 157 of the illumination device 150 includes a secondary battery 214, a radio communication control portion 2, 210 and a radio communication portion 2, 212.

The secondary battery 214 is connected with the voltage conversion portion 215 of the illumination portion 156 and stores the energy while the power is supplied to the illumination device 150. The radio communication control portion 2, 210 transmits, via the radio communication portion 2, 212, the terminal ID received from the radio terminal 120 and the device ID stored in the ROM 204 of the illumination portion 156 to the management apparatus 110 through the gateway 140.

The connection terminals 153 and the connection terminals 155 are installed at the respective sides of the illumination device 150. The connection terminals 153 include a pair of power and ground terminals, the connection terminals 155 also include a pair of power and ground terminals, and both are connected with the power control portion 217 of the illumination portion 156 through the connection terminals 1611 and the connection terminals 1621 connecting the illumination portion 156 and the housing portion 157. Alternatively, such a configuration can be implemented that only the connection terminals 153 or the connection terminals 155 are connected with the power control portion 217 and supply the power to the power control portion 217.

The power converted by the voltage conversion portion 215 of the illumination portion 156 is supplied to the secondary battery 214 and the radio communication control portion 2, 210 of the housing portion 157 via the connection terminals 1612 and the connection terminals 1622 connecting therebetween.

From the CPU 200 of the illumination portion 156, two lines of signals needed for serial communication are transmitted to the radio communication control portion 2, 210 of the housing portion 157 via the connection terminals 1613 and the connection terminals 1623 connecting therebetween.

Figure 12:
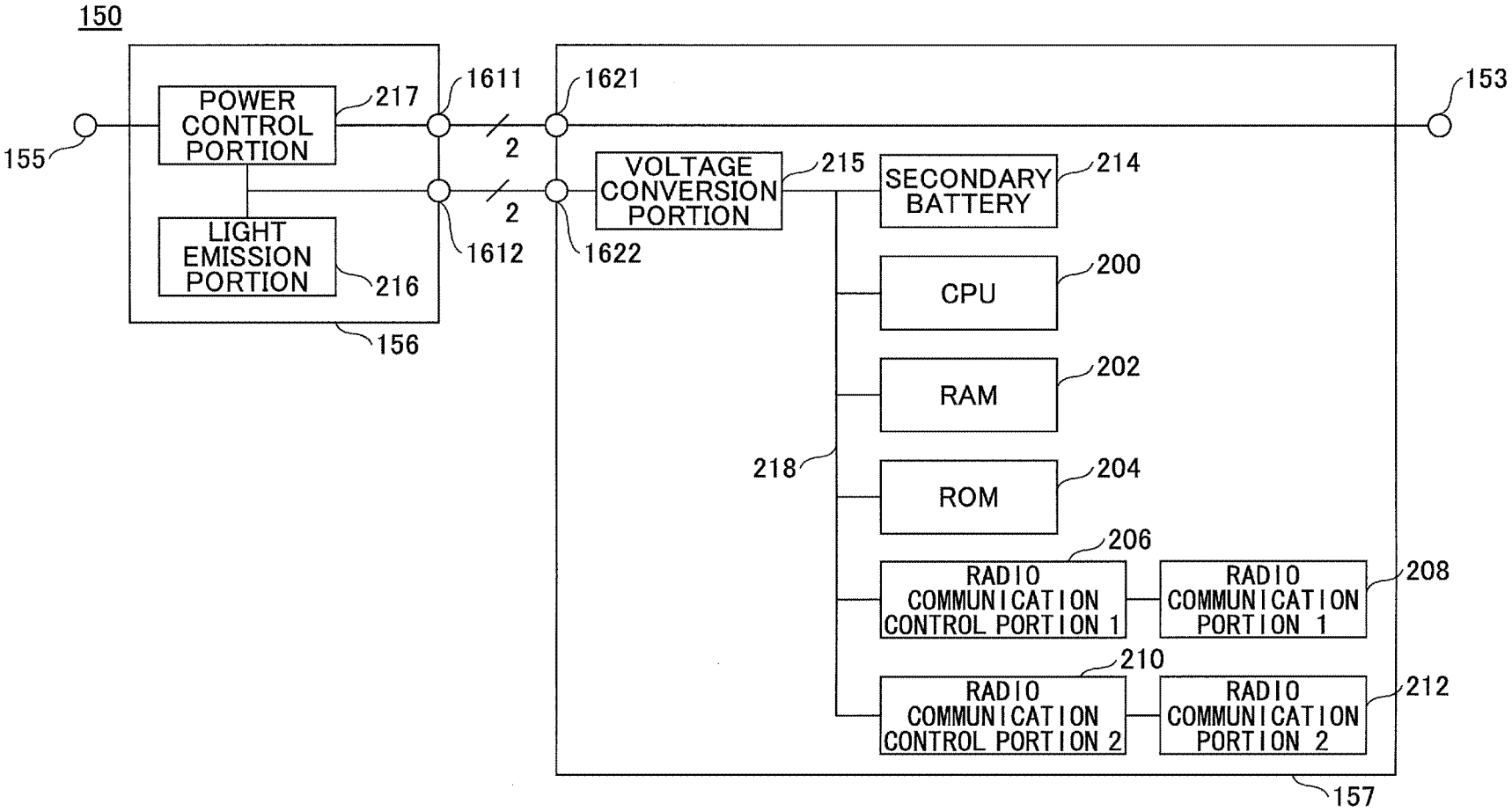
FIG. 12 illustrates a hardware configuration of the illumination device according to the embodiment in another example.

FIG. 12 illustrates a hardware configuration of the illumination device 150 in a case where the illumination device 150 has the configuration illustrated in FIG. 8. In the configuration illustrated in FIG. 8, the first radio communication device 165, the first radio communication module 166, the second radio communication device 168, the second radio communication module 169, the secondary battery 170, the voltage conversion module 171 and the CPU module 172 are installed in the housing portion 157.

In such a configuration, the illumination portion 156 includes the power control portion 217 and the light emission portion 216, as shown in FIG. 12. The housing portion 157 includes the voltage conversion portion 215, the secondary battery 214, the CPU 200, the RAM 202, the ROM 204, the radio communication control portion 1, 206, the radio communication portion 1, 208, the radio communication control portion 2, 210 and the radio communication portion 2, 212.

The connection terminals 153 and the connection terminals 155 are installed at the respective sides of the illumination device 150. The connection terminals 153 include a pair of power and ground terminals, the connection terminals 155 also include a pair of power and ground terminals, and both are connected with the power control portion 217 of the illumination portion 156. The connection terminals 153 at the side of the housing portion 157 are connected with the power control portion 217 through the connection terminals 1611 and the connection terminals 1621 connecting the illumination portion 156 and the housing portion 157.

The power rectified and smoothed by the power control portion 217 of the illumination portion 156 is supplied to the voltage conversion portion 215 of the housing portion 157 via the connection terminals 1612 and the connection terminals 1622 connecting therebetween by the pair of power and ground.

Figure 13:
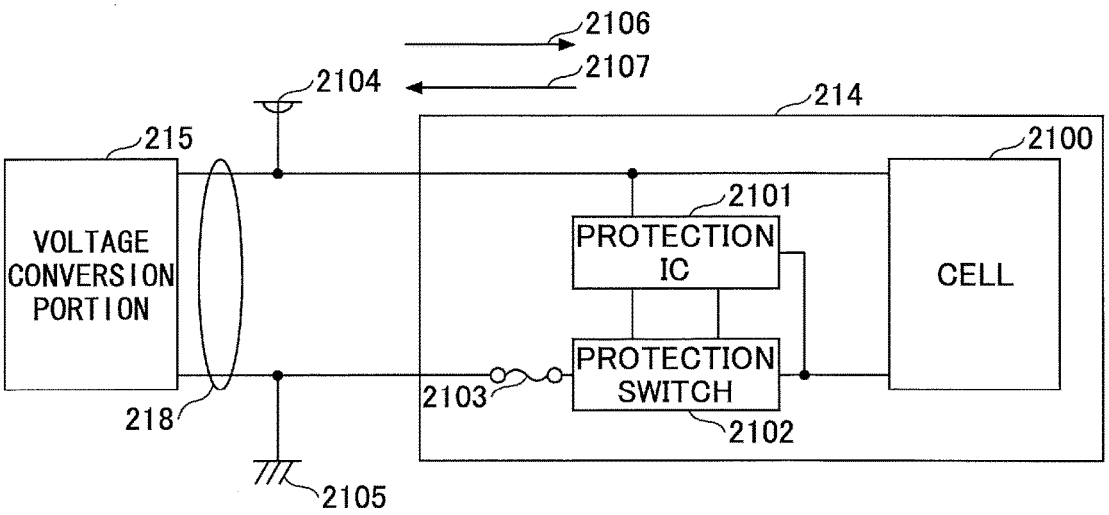
FIG. 13 illustrates a secondary battery and a related circuit according to the embodiment.

FIG. 13 illustrates the secondary battery 214 and a related circuit according to the embodiment.

The secondary battery 214 includes a cell 2100, a protection IC 2101, a protection switch 2102 and a temperature fuse 2103, is connected with the voltage conversion portion 215 and is connected with a power supply line 2104 and a ground line 2105 that form the bus 218.

The power supply line 2104 and the ground line 2105 are also connected with the CPU 200, the RAM 202 and so forth of the illumination device 150. The voltage between the power supply line 2104 and the ground line 2105 is converted by the voltage conversion portion 215 into a voltage capable of being used by the CPU 200 and so forth.

Power is supplied to the secondary battery 214 from the voltage conversion portion 215, a current flows through the power supply line 2104 in a direction 2106 shown in FIG. 13 until the cell 2100 is fully charged, and thus, the cell 2100 is charged. When the cell 2100 is thus fully charged, the protection IC 2101 causes the protection switch 2102 to operate to cut off the current in the direction 2106 and avoid excessive charging.

When the power supply from the voltage conversion portion 215 is stopped, the cell 2100 starts discharging and a current flows through the power supply line 210 in a direction 2107 shown in FIG. 13. When the voltage of the power supplied by the cell 2100 is reduced to be less than or equal to a certain level, the protection IC 2101 causes the protection switch 2102 to operate to cut off the current in the direction 2107 and avoid excessive discharging.

The temperature fuse 2103 cuts the current path between the power supply line 2104 and the ground line 2105 through the cell 2100 when the temperature of the protection switch 2102 becomes abnormally high.

<Example of Hardware Configuration of Radio Terminal>

Figure 14:
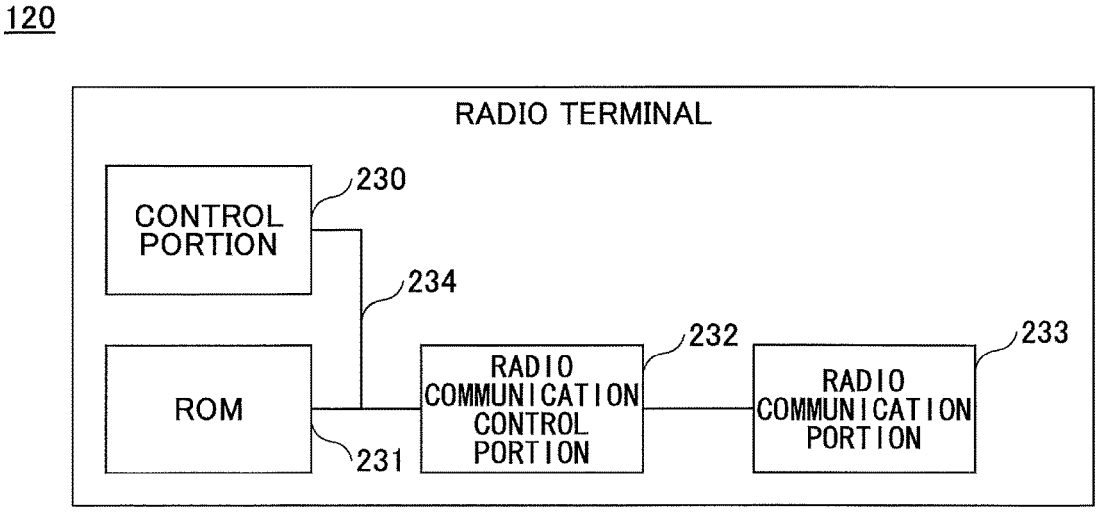
FIG. 14 illustrates a hardware configuration of a radio terminal according to the embodiment.

FIG. 14 illustrates a hardware configuration of the radio terminal 120 according to the embodiment. The radio terminal 120 includes a control portion 230, a ROM 231, a radio communication control portion 232, a radio communication portion 233 and a bus 234.

The control portion 230 carries out communication control in the radio terminal 120. The ROM 231 stores a program(s) executed by the control portion 230 and the terminal ID(s). The radio communication control portion 232 transmits a beacon signal including the terminal ID via the radio communication portion 233. The bus 234 connects the above-mentioned respective portions electrically.

Note that the management apparatus 110 and the gateway 140 usable in the embodiment can be configured with general-purpose computers or server apparatuses.

<3. Functions>

Next, the functions of the radio terminal 120, the illumination device 150 and the management apparatus 110 according to the present embodiment will be described in detail based on the figures.

<Functions of Radio Terminal>

Figure 15:
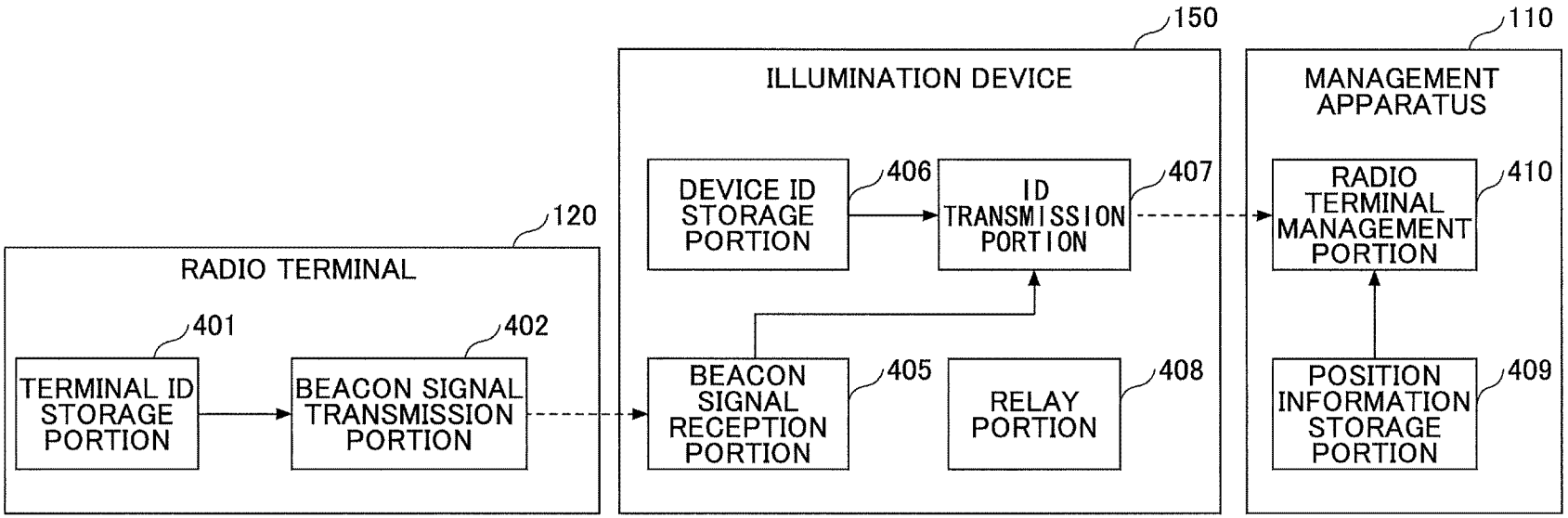
FIG. 15 is a functional block diagram of a communication system according to the embodiment.

As illustrated in FIG. 15, the radio terminal 120 according to the embodiment includes a terminal ID storage portion 401 and a beacon signal transmission portion 402.

The terminal ID storage portion 401 is implemented by the ROM 231 of FIG. 14, and stores the terminal ID that is an identifier to identify the radio terminal 120 in the position management system 1. The terminal ID can be expressed by a combination of any character(s)/letter(s), numeral(s), symbol(s) and/or so. For example, when the radio terminal 120 is attached to a person, the terminal ID can be an identification number assigned to the person (for example, an employee number such as "000535").

The beacon signal transmission portion 402 is mainly implemented by the radio communication control portion 232 and the radio communication portion 233 of FIG. 14, reads out the terminal ID stored by the terminal ID storage portion 401 and transmits the beacon signal including the thus acquired the terminal ID via, for example, extremely low power radio. The beacon signal transmission portion 402 transmits the beacon signal periodically, for example, at a predetermined time(s) of day or every predetermined interval of time. The beacon signal transmission portion 402 can transmit the beacon signal also in response to a signal given by a person or externally.

<Functions of Illumination Device>

The illumination device 150 according to the embodiment includes a beacon signal reception portion 405, a device ID storage portion 406, an ID transmission portion 407 and a relay portion 408.

The beacon signal reception portion 405 is mainly implemented by the CPU 200, the radio communication control portion 1, 206 and the radio communication portion 1, 208 of FIG. 11, and receives the beacon signal transmitted from the beacon signal transmission portion 402 of the radio terminal 120. Then, the beacon signal reception portion 405 acquires the terminal ID included in the beacon signal and transfers the acquired terminal ID to the ID transmission portion 407.

The device ID storage portion 406 is mainly implemented by the ROM 204 of FIG. 11, and stores the device ID that is an identifier to identify the luminaire 100 in the position management system 1. The device ID can be expressed by a combination of any character(s)/letter(s), numeral(s), symbol(s) and/or so. For example, when the luminaire 100 is installed on a ceiling of an office, the device ID can be a character and numeral string indicating a general position of the office (for example, "C20N001" denoting the "1"st luminaire in the "North" area on the "20"th floor of the building "C").

The ID transmission portion 407 is mainly implemented by the CPU 200, the radio communication control portion 2, 210 and the radio communication portion 2, 212 of FIG. 11. When receiving the terminal ID from the beacon signal reception portion 405, the ID transmission portion 407 transmits the terminal ID and the device ID read out from the device ID storage portion 406 to the management apparatus 110. Note that the ID transmission portion 407 can transmit the terminal ID and the device ID to the management apparatus 110 via the gateway 140 (and another luminaire 102 and so forth if necessary) connected through the radio network.

The relay portion 408 is mainly implemented by the CPU 200, the radio communication control portion 2, 210 and the radio communication portion 2, 212 of FIG. 11, receives the terminal ID and the device ID transmitted by another illumination device 150, and transfers them to yet another illumination device or the gateway 140. For example, when the radio network is formed according to ZigBee, the relay portion 408 can provide a relay function in the network by a ZigBee router.

<Functions of Management Apparatus>

The management apparatus 110 according to the present embodiment includes a position information storage portion 409 and a radio terminal management portion 410.

The position information storage portion 409 stores position information such as that illustrated in FIG. 16 where the device IDs stored by the illumination devices 150 and the installation positions of the illumination devices 150 having the device IDs are associated with each other.

The device IDs are unique IDs given to the respective illumination devices 150 and the (installation) positions mean positions in the space that the position management system 1 manages. For example, the position can be expressed by two-dimensional coordinates (X, Y) with respect to a reference point in the floor. It is also possible that the position is expressed by any information capable of identifying a physical place such as longitude and latitude, the number of the building, the name of the building, the floor, the place name, the address, the postcode, the altitude or so.

When receiving the terminal ID and the device ID from the illumination device 150, the radio terminal management portion 410 searches the position information (see FIG. 16) by using the received device ID as a key and reads out the corresponding position. Then, the radio terminal management portion 410 stores the thus acquired position, the terminal ID and the time when having received the terminal ID in a table illustrated in FIG. 17 as radio terminal information. The specific method of storing the terminal IDs are not limited to that of FIG. 17, and the radio terminal management portion 410 can store the terminal IDs in any other format.

The management apparatus 110 can carry out an operation check by carrying out communication with the illumination device 150 at a fixed cycle. Thereby, it is possible to detect an occurrence of an unexpected state, if any, in the illumination device 150, for example. It is also possible to detect that charging or replacement of the housing portion is needed when the secondary battery has been completely discharged in a state where the power supply is cut off so that it is no longer possible to supply the power to the illumination portion 156 and so forth.

By using the thus stored positions of the radio terminals 120, the management apparatus 110 can display the positions of the radio terminals 120 on a map, output a list of the terminal IDs of the radio terminals 120 present at or around a position designated by a user, and so forth, for example. Note that in FIG. 17, the terminal IDs of the radio terminals 120 and the positions of the luminaires (illumination devices 150) are associated with each other. Therefore, when using such table information as that illustrated in FIG. 17, the positions of the corresponding luminaires can be determined as the positions of radio terminals 120. As a result, when the radio terminal 120 moves from a position near one luminaire to another position near another luminaire, the position of the one luminaire is determined as the position of the radio terminal 120 first, and thereafter, the position of the other luminaire is determined as the position of the radio terminal 120.

<4. Operation Example>

Figure 18:
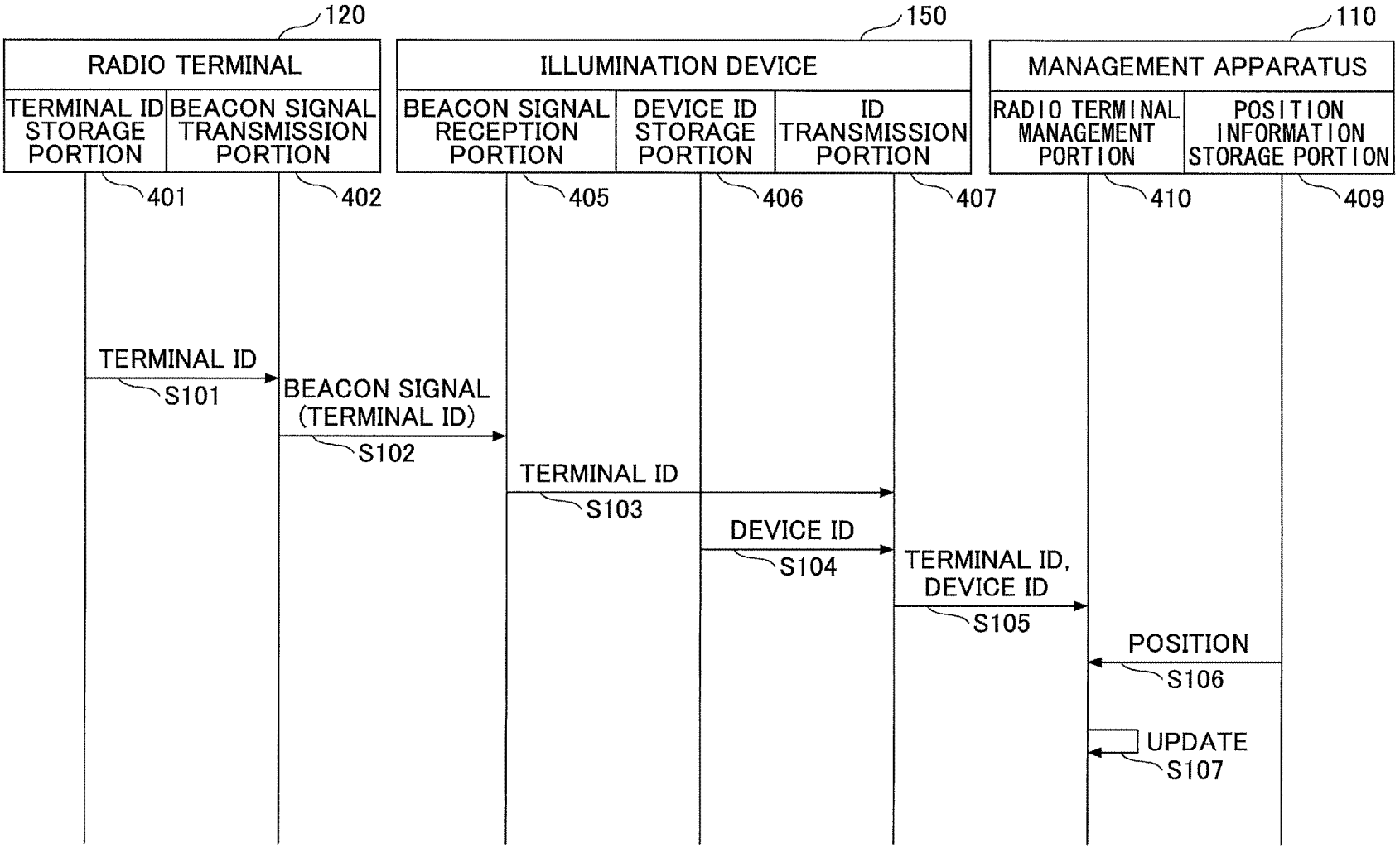
FIG. 18 is a sequence diagram illustrating an example of operations of the communication system according to the embodiment.

Using FIG. 18, an operation example of the position management system 1 according to the present embodiment will be described. According to the present embodiment, the position management system 1 manages positions of persons (employees) in an office. The persons carry things such as employee ID cards, cellular phones or company PCs to which the respective radio terminals 120 are attached and move in the office.

Below, an example is assumed where the terminal ID of the radio terminal 120 a certain employee has is "000535" and the device ID of the illumination device 150 present near the employee is "C20N001". Also, as illustrated in FIG. 16, the management apparatus 110 previously stores the position information including information of the position where the illumination device 150 having the device ID of "C20N001" is installed.

When this employee moves to a position near the illumination device 150 having the above-mentioned device ID, the beacon signal transmission portion 402 of the radio terminal 120 reads out the terminal ID "000535" from the terminal ID storage portion 401 (Step S101). The beacon signal transmission portion 402 transmits the beacon signal including the thus acquired terminal ID toward the near illumination device 150 by extremely low power radio (Step S102).

The beacon signal reception portion 405 of the illumination device 150 transfers the terminal ID "000535" included in the received beacon signal to the ID transmission portion 407 (Step S103). The ID transmission portion 407 acquires the device ID "C20N001" from the device ID storage portion 406 (Step S104). Then, the ID transmission portion 407 transmits the terminal ID "000535" and the device ID "C20N001" toward the management apparatus 110 via the radio network of IEEE 802.15.4 and ZigBee (Step S105). Then, the terminal ID and the device ID are transmitted to the management apparatus 110 via another illumination device(s) and the gateway 140 included in the radio network.

When receiving the terminal ID and the device ID from the illumination device 150, the management apparatus 110 searches the position information (see FIG. 16) stored by the position information storage portion 409 using the received device ID as a key, and reads out the position corresponding to the device ID (Step S106). Here, according to FIG. 16, the position (x1, y1) is read out. Then, the radio terminal management portion 410 updates the radio terminal information (see FIG. 17) by associating the thus acquired position (x1, y1) with the terminal ID "000535" and "2013/11/21 13:14:00" that are the reception date and time (Step S107).

Through these operations, the position management system 1 according to the present embodiment manages the position of the employee having the radio terminal 120. As a result of the illumination device 150 having the secondary battery 170, the luminaire 100 can carry out communication with the radio terminal 120 and the management apparatus 110 even when the power supply is cut off, and the position management system 1 can still manage the position of the radio terminal 120. Also, since the radio terminal 120 carries out communication with the illumination device 150 using extremely low power radio, the energy consumption is low. Also, since the illumination device 150 and the gateway 140 carry out communication together by a different radio communication method from a method for carrying out communication between the illumination device 150 and the radio terminal 120, it is possible to avoid degradation in throughput of the network otherwise occurring due to radio wave interference.

Note that, instead of radio communication using extremely low power radio, the radio terminal 120 can carry out radio communication according to IEEE 802.15.4 and ZigBee used by the illumination device 150 and the gateway 140. In this case, the radio terminal 120 functions as a ZigBee end device. Thereby, it becomes unnecessary to provide the radio communication control portion 1, 206 and the radio communication portion 1, 208 (FIG. 11) to be used for carrying out communication with the radio terminals 120 in the illumination device 150. As a result, it becomes possible to manufacture the illumination device 150 at a reduced cost.

Although the illumination device and the communication system have been described in the embodiment, the present invention is not limited to the embodiment, and variations and modifications may be made without departing from the scope of the present invention.

The present application is based on and claims the benefit of priority of Japanese Priority Application No. 2013-254138 filed on Dec. 9, 2013 and Japanese Priority Application No. 2014-178969 filed on Sep. 3, 2014, the entire contents of which are hereby incorporated herein by reference.

What is claimed is:

1. An illumination device comprising:

at least one terminal, configured to receive power from an external source:

a reception portion configured to receive a terminal ID from a radio terminal;

a transmission portion configured to transmit the received terminal ID and a device ID of the illumination device, to another device;

an illumination portion, including at least one or more light sources, configured to receive power from the external source via the at least one terminal and to emit light; and a housing portion, including a battery and configured to be separate from and detachably connectable to the illumination portion, the battery being configured to supply power to the reception portion and the transmission portion, at least in the absence of power being received via the at least one terminal.

2. The illumination device as claimed in claim 1, wherein the housing portion is configured to include at least one of the reception portion and the transmission portion.

3. The illumination device as claimed in claim 1, wherein the housing portion is configured to include have a light reflection member to reflect the light from the at least one or more light sources.

4. The illumination device as claimed in claim 1, wherein the reception portion is configured to receive the terminal ID by extremely low power radio.

5. The illumination device as claimed in claim 4, wherein the reception portion is configured to receive the terminal ID included in a beacon signal transmitted at each of plural intervals of time.

6. The illumination device as claimed in claim 4, wherein the transmission portion is configured to transmit the terminal ID and the device ID by a radio communication method different from the extremely low power radio.

7. The illumination device as claimed in claim 5, wherein the transmission portion is configured to transmit the terminal ID and the device ID by a radio communication method different from the extremely low power radio.

8. A communication system comprising:

the illumination device claimed in claim 1; and a management apparatus configured to manage a position of the radio terminal, wherein the transmission portion of the illumination device is configured to transmit the terminal ID and the device ID to the management apparatus.

9. The communication system as claimed in claim 8, wherein a housing portion of the illumination device is configured to include at least one of the reception portion and the transmission portion.

10. The communication system as claimed in claim 8, wherein the housing portion of the illumination device is configured to have a light reflection member reflecting the light from the at least one or more light sources.

11. The communication system as claimed in claim 8, wherein the reception portion of the illumination device is configured to receive the terminal ID by extremely low power radio.

12. The communication system as claimed in claim 11, wherein the reception portion of the illumination device is configured to receive the terminal ID included in a beacon signal transmitted at each of plural intervals of time.

13. The communication system as claimed in claim 11, wherein the transmission portion of the illumination device is configured to transmit the terminal ID and the device ID by a radio communication method different from the extremely low power radio.

14. The communication system as claimed in claim 12, wherein the transmission portion of the illumination device is configured to transmit the terminal ID and the device ID by a radio communication method different from the extremely low power radio.

15. The communication system as claimed in claim 8, further comprising:

a relay apparatus configured to relay the terminal ID and the device ID transmitted from the transmission portion.

16. The illumination device as claimed in claim 1, wherein the battery is configured to supply power to and maintain operation of the reception portion and the transmission portion, independent of power externally supplied to the illumination portion.

17. The illumination device as claimed in claim 1, wherein the at least one terminal is configured to supply the externally supplied power to at least the illumination portion, the battery being configured to store externally supplied power and to supply power to the reception portion and the transmission portion, at least in the absence of the externally supplied power.

18. The illumination device as claimed in claim 1, wherein illumination portion includes a plurality of light sources capable of generating heat, and wherein the battery is separate from the plurality of heat generating light sources of the illumination portion.

19. A communication system comprising:

the illumination device claimed in claim 17; and a management apparatus configured to manage a position of the radio terminal, wherein the transmission portion of the illumination device is configured to transmit the terminal ID and the device ID to the management apparatus.

20. A communication system comprising:

the illumination device claimed in claim 18; and a management apparatus configured to manage a position of the radio terminal, wherein the transmission portion of the illumination device is configured to transmit the terminal ID and the device ID to the management apparatus.

* * * * *